US007143654B2

(12) United States Patent
Raffle et al.

(10) Patent No.: US 7,143,654 B2
(45) Date of Patent: Dec. 5, 2006

(54) METHODS AND APPARATUS FOR DETECTING THE PRESENCE, INTENSITY, TRAJECTORY OR LOCATION OF A LIQUID STREAM

(75) Inventors: Hayes Solos Raffle, Cambridge, MA (US); Daniel Maynes-Aminzade, Mountain View, CA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 11/010,176

(22) Filed: Dec. 10, 2004

(65) Prior Publication Data

US 2005/0172728 A1 Aug. 11, 2005

Related U.S. Application Data

(60) Provisional application No. 60/528,873, filed on Dec. 11, 2003.

(51) Int. Cl.
*G01N 3/08* (2006.01)

(52) U.S. Cl. ..... 73/820

(58) Field of Classification Search ..... 73/820
See application file for complete search history.

(56) References Cited

U.S. PATENT DOCUMENTS 3,166,934 A * 1/1965 Kruse et al. ..... 73/820
3,199,341 A * 8/1965 Heuer, Jr. et al. ..... 73/807
3,592,042 A * 7/1971 Martinex ..... 73/23.2
4,621,268 A * 11/1986 Keeling et al. ..... 347/82
4,947,691 A * 8/1990 Schultz ..... 73/753
5,277,927 A * 1/1994 Burns et al. ..... 427/8
5,411,269 A * 5/1995 Thomas ..... 273/349
5,523,808 A * 6/1996 Kohayakawa ..... 351/210
5,753,806 A * 5/1998 Ryan et al. ..... 73/119 A
5,823,849 A * 10/1998 Gardner et al. ..... 446/473
5,893,562 A * 4/1999 Spector ..... 273/349
6,364,219 B1 * 4/2002 Zimmerman et al. ..... 239/394
6,457,655 B1 * 10/2002 Reighard et al. ..... 239/8
6,508,112 B1 * 1/2003 Verhoeven ..... 73/119 A
6,581,674 B1 * 6/2003 Kroos et al. ..... 164/463

* cited by examiner

*Primary Examiner*—Max Noori
*Assistant Examiner*—Octavia Davis
(74) *Attorney, Agent, or Firm*—Charles G. Call

(57) ABSTRACT

An array of piezoelectric ceramic sensors affixed to a flexible plastic membrane forms a target surface and the signals produced by the sensors are processed to produce an output signal which indicates the location where a liquid stream strikes the target. The sensor array is used to detect the presence and location of a liquid stream from a pressurized nozzle used to play an interactive game. The stream presence and position signals are fed in real time to a (personal) computer which produces an output display indicating where the target was struck by the stream. The stream detection array may be used in a variety of applications.

12 Claims, 2 Drawing Sheets

207

METHODS AND APPARATUS FOR DETECTING THE PRESENCE, INTENSITY, TRAJECTORY OR LOCATION OF A LIQUID STREAM

CROSS REFERENCE TO RELATED APPLICATION

This application is a Non-Provisional of, and claims the benefit of the filing date of, U.S. Provisional Patent Application Ser. No. 60/528,873 filed on Dec. 11, 2003, the disclosure of which is incorporated herein by reference.

REFERENCE TO COMPUTER PROGRAM LISTING APPENDIX

A computer program listing appendix is stored on each of two duplicate compact disks which accompany this specification. Each disk contains computer program listings which illustrate implementations of the invention. The listings are recorded as ASCII text in IBM PC/MS DOS compatible files which have the names, creation dates, and sizes (in bytes) listed below:

| File Name | Created | Bytes |
|---|---|---|
| constants.h.txt | Nov. 05, 2004 11:02 PM | 954 |
| Hampster.cpp.txt | Nov. 05, 2004 11:02 PM | 2,894 |
| Hampster.h.txt | Nov. 05, 2004 11:02 PM | 422 |
| precomp.cpp.txt | Nov. 05, 2004 11:02 PM | 22 |
| precomp.h.txt | Nov. 05, 2004 11:02 PM | 403 |
| resource.h.txt | Nov. 05, 2004 11:02 PM | 536 |
| serial.cpp.txt | Nov. 05, 2004 11:01 PM | 4,215 |
| serial.h.txt | Nov. 05, 2004 11:01 PM | 797 |
| YIC.cpp.txt | Nov. 05, 2004 11:01 PM | 8,216 |
| YIC.h.txt | Nov. 05, 2004 11:00 PM | 1,851 |
| YIC.rc.txt | Nov. 05, 2004 11:00 PM | 1,973 |
| YIC.sln.txt | Nov. 05, 2004 10:59 PM | 913 |
| YIC.vcproj.txt | Nov. 05, 2004 10:59 PM | 3,847 |
| YIC_PIC_Code.c.txt | Nov. 05, 2004 PM | 3,847 |

COPYRIGHT AUTHORIZATION

A portion of the disclosure of the accompanying Computer Program Listing Appendix contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This invention relates to liquid stream sensing devices.

SUMMARY OF THE INVENTION

In its preferred embodiment, the present invention detects the presence of a liquid stream and the position at which the stream impinges upon a target. The target is formed by one or more sensing devices, each of which producing an output signal when a liquid stream impinges upon a region near to the sensing device. A signal processor coupled to the sensor array for produces a position signal that indicates the presence, location, trajectory or velocity of the stream that impinges on the sensor(s).

The sensing devices may be located along a straight or curved line and the signal processor produces a position signal that indicates the location of said stream relative to said line. Alternatively, the sensors may be organized in a two dimensional array on a target surface and the signal processor generates an output signal that indicates the location where the stream impinges on the target surface.

The individual sensors may produce a binary signal indicating whether or not the stream impacts the target surface in the vicinity of the sensor, or may produce an output signal having a magnitude indicating the intensity with which the stream impinges on the target surface in the vicinity of the individual sensor. In either case, the signal processor may derive a position signal from the weighted combination of output signals produced by different ones of said sensing devices, thereby providing a position signal with greater resolution.

The individual sensors may advantageously take the form of a transducer attached to a flexible membrane which detects deformation of the membrane caused by the stream impacting the target in the vicinity of the sensor. The transducer may be a piezoelectric element, such as a ceramic "buzzer," affixed to the membrane by a suitable adhesive.

The signal processing circuit may advantageously includes a analog signal processor including an amplifier and an envelope follower circuit which supplies signal values to a microprocessor that in turn produces a desired output for controlling a particular application.

The stream sensing mechanism contemplated by the invention may be used in a variety of control applications, such as interactive games, stream control systems, and any other application in which the employs means for sensing the presence, position, trajectory or intensity of a liquid stream.

These and other features and advantages of the invention will be better understood by considering the following detailed description.

BRIEF DESCRIPTION OF THE DRAWINGS

In the detailed description which follows, frequent reference will be made to the attached drawings, in which.

DETAILED DESCRIPTION

The present invention may be used in a variety of applications in which it is desirable to detect the presence, intensity or location of a liquid stream.

Figure 1:
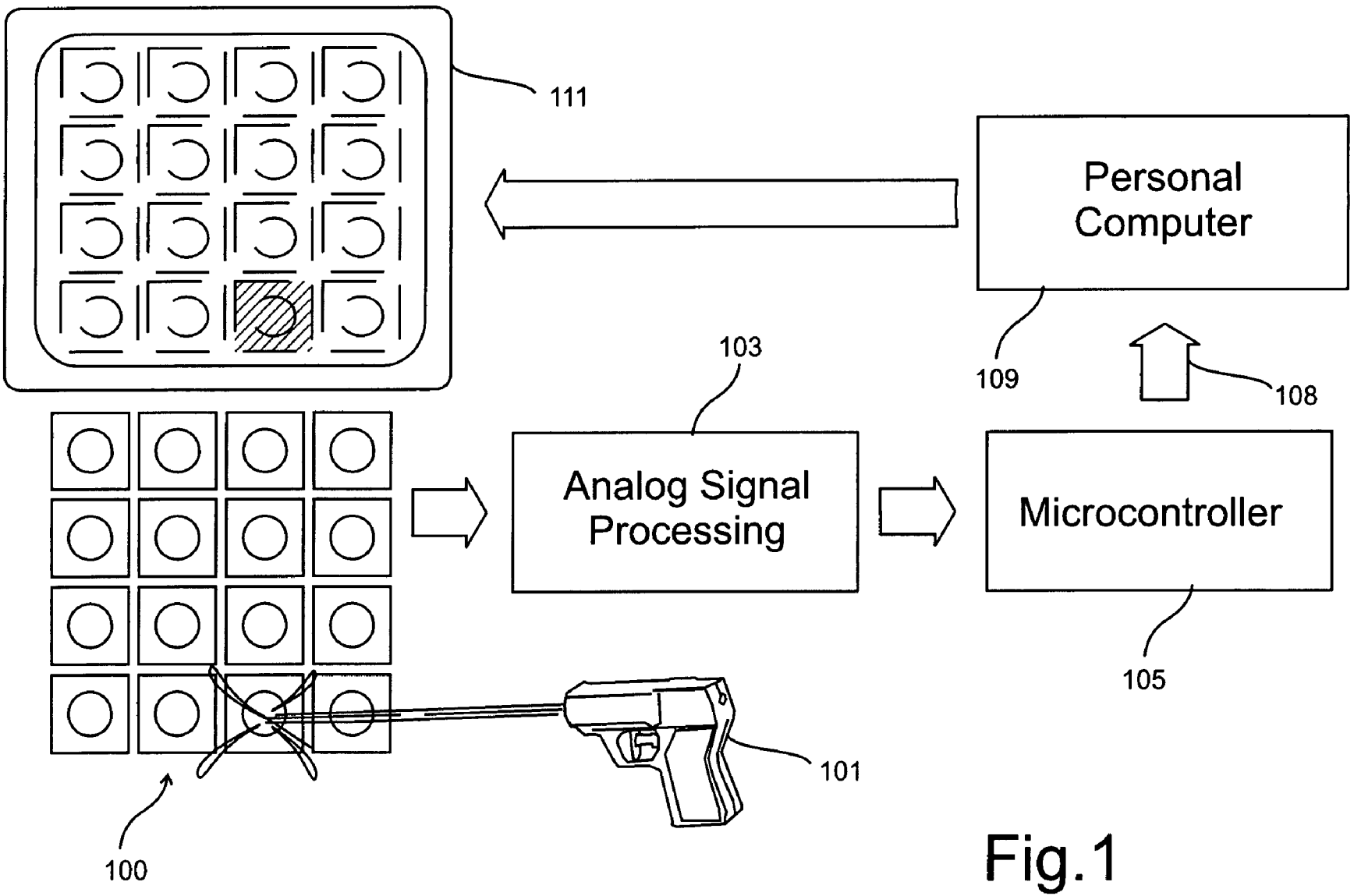
FIG. 1 is schematic block diagram of a first embodiment of the invention.

An illustrative embodiment of the invention shown in FIG. 1 consists of a two-dimensional 4×4 array of sensors 100. The sixteen sensors in the array 100 are arranged on a rectangular target surface. A liquid stream 101 from a squirt gun 102 is directed at the target surface. Each sensor produces a signal that indicates whether or not the liquid stream 101 hits the target surface in the immediate vicinity of that sensor. Each sensor output signal is amplified and shaped by an analog signal processing circuit 103 comprising sixteen parallel circuits, one of which is shown in detail in FIG. 4 and is described below. The resulting signals are delivered to the digital input pins of a microcontroller 107 which interprets the sixteen sensor output signals and produces stream position data in real time. The stream position data is fed in real time via a connection 108 to the serial input port of a personal computer 109.

In the illustrative embodiment, the personal computer 109 is programmed to provide an interactive game in which the player holds the squirt gun 102 and directs it at the target surface holding the sensor array 100. The player views the display produced by the PC 109 on a monitor 111.

The program that executes on the PC 109 reads the stream position data from the microcontroller 107 sent over a serial data link seen at 108 at a rate of 100 samples per second. Although the input sensors form a relatively low resolution 4×4 grid, the PC software provides higher output resolution and reduces sampling jitter by using temporal supersampling. For each frame, the PC game program computes the centroid of the positions of all of the activated sensors and feeds this value into a low-pass smoothing filter (mean filter) to produce a final position stream position for that frame as indicated at 121 on the monitor 111. The software displays this computed centroid position of the stream on the PC monitor 111 to give the game player a real time indication of the position at which the liquid stream.

The game program that executes on the PC 109 operates as a variant of Whac-A-Mole®, a classic carnival game marketed by BOB'S SPACE RACERS, INC. of Daytona Beach Fla. In this liquid stream version, the game player aims a series of jumping hamsters which appear on the monitor 111, with input position on the target array 100 corresponding to position on the screen 111 above. A successful hit turns a displayed hamster at that position yellow, makes it scream and spin, and rewards the player with ten points. The parabolic trajectories of the hamsters conceal the grid-like arrangement of sensors, resulting in a fluid transition between input and output. The C++ source language for the game software executes on the PC 100 is listed in the accompanying CD-ROM Computer Program Listing Appendix.

Figure 2:
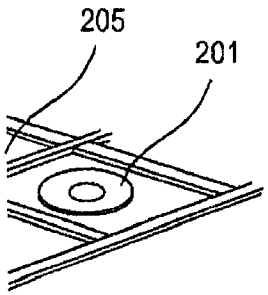
FIG. 2 is a perspective view of a portion of a sensor array structure which may be used to detect the presence and location of a liquid stream.

The hardware used to implement this illustrative embodiment of the invention is inexpensive, reliable, fast and physically robust. The array 100 is formed using sixteen piezoelectric ceramic buzzers, one of which is seen at 201 in FIG. 2. The piezoelectric sensors are each affixed by a suitable adhesive to a flexible plastic membrane 205. Foam tape strips seen at 207 mechanically isolate areas of the plastic membrane adjacent each sensor from one another, such that each sensor measures deformations of the membrane in that region in response to the liquid stream impinging on the membrane. If the membrane is mounted to a curved surface, the gain of the amplifier for each sensor, described below, can be individually adjusted to compensate for uneven tension in the membrane.

Figure 4:
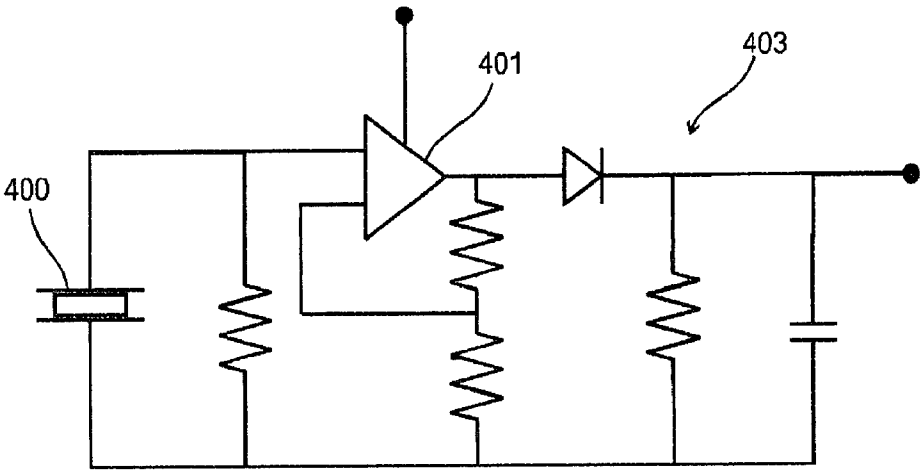
FIG. 4 is a schematic diagram of an analog signal processing circuit for translating the output of a pressure responsive transducer into a signal value indicating the presence and intensity of a liquid stream at a particular location.

Each piezoelectric ceramic sensor, seen at 400 in FIG. 4, produces a low-amplitude voltage which is processed by a two-stage signal processing circuit. The first stage includes an amplifier 401 with a gain ranging from 10–100 and the second stage is an envelope follower seen generally at 403 which curbs the signal attenuation. A 16F877 PIC microcontroller receives the signals as digital inputs. The PIC 16F866 microcontroller is available from Microchip Technology, Inc. in Chandler, Ariz., and includes a processor, system timers, four eight-bit I/O ports, a serial data I/O port, an 8K flash memory for programs, 368 bytes of data memory, and 256 bytes of EEPROM memory. The firmware for the 16F877 microcontroller is listed in the accompanying CD-ROM Computer Program Listing Appendix in the file named "YIC_PIC_Code.c." The impact of a stream of liquid on a sensor creates a signal that exceeds the 2.5-Volt threshold necessary to send the microcontroller's digital inputs high.

The embodiment described above employs the digital inputs to the microcontroller 105 because those inputs can be read more rapidly, and the low resolution provided by the digital inputs was sufficient for creating the interactive activity needed for the game application. An alternate embodiment could read analog signal amplitudes rather than digital thresholds, thereby indicating the intensity with which the stream impinges upon the region in the vicinity of each sensor. By measuring the amount of deformation at each sensor position, an alternative arrangement can use fewer sensors and calculate the stream position at a location between two or more sensors. Signal processing techniques that create smooth visual output that corresponds to low resolution, discrete inputs are described, for example, in U.S. Pat. No. 6,381,377 entitled "Generating a high resolution scan image with a low resolution scan sensor" and U.S. Pat. No. 6,005,682 entitled "Resolution enhancement by multiple scanning with a low-resolution, two-dimensional sensor array," the disclosures of which are incorporated herein by reference.

Figure 3:
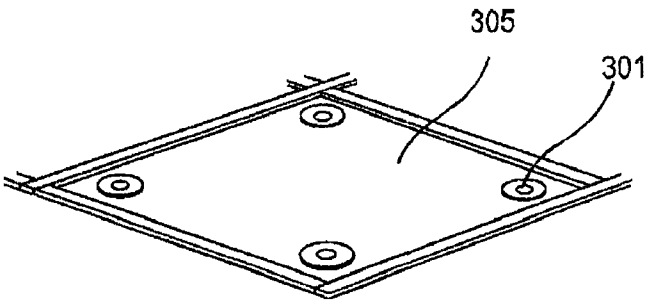
FIG. 3 is a perspective view of a portion of an alternative sensor structure for detecting the presence and location of a liquid stream.

An arrangement of this type is shown in FIG. 3 in which a sensor 301 is positioned at each corner of a larger rectangular membrane 305. The analog signal produced at the output of the analog signal processing circuit (seen in FIG. 4) indicates the degree to which the membrane 305 at each sensor position is deformed. The position of the stream can be determined by reading analog values from the sensors and triangulating the position of the liquid stream based on signal amplitude. The arrangement shown in FIG. 3 can be used to reduce system cost by reducing the number of sensors and to increase tracking resolution for a given number of sensors.

The two sensor arrays described above employ sensors arranged to form a two-dimensional target surface; however, for some applications, a linear (one dimensional) array of sensors may be used. By way of example, a one-dimensional array of sensors may be used to produce an output data value whose magnitude is controlled by altering the position at which a liquid stream impinges upon a linear target. By way of example, a fixed nozzle can direct a stream in a trajectory toward a linear target, and the point at which the stream contacts the target may be detected to determine the liquid pressure at the nozzle. The same arrangement may be used as an accelerometer since, when the point at which the stream contacts the target array changes as the acceleration forces deflect the trajectory of the stream. In still another arrangement, a stream containing ions may be deflected by amount related to the field strength and/or the charge-to-mass relationship of the ion stream, so that the stream position indicator acts as a field strength detector or a mass-spectrometer.

The liquid stream may be produced by a variety of different devices, depending on the application. In a decorative water fountain, car wash, or industrial application, an array of sensors may be used in a feedback arrangement to control one or more valves in order to regulate the water pressure to ensure that the stream assumes a desired configuration and impinges on the target array at a desired location.

CONCLUSION

It is to be understood that the methods and apparatus which have been described above are merely illustrative applications of the principles of the invention. Numerous modifications may be made by those skilled in the art without departing from the true spirit and scope of the invention.

What is claimed is:

1. Apparatus for detecting the position of at which a liquid steam that is directed through the air from a nozzle impinges upon a deformable planar member, said apparatus comprising, in combination, an array of two or more of spaced-apart sensing devices, each given one of said sensing devices being coupled to said deformable planar member to detect the deformation of said planar member and produce an output signal when said stream impinges upon and deforms a region of said planar member near said given one of said sensing devices, and output means coupled to said array for producing a position signal which indicates the location at which said stream impinges on said array.

2. Apparatus for detecting the position of a liquid steam as set forth in claim 1 wherein said sensing devices are located along a straight or curved line and wherein said position signal indicates the location of said stream relative to said line.

3. Apparatus for, detecting the position of a liquid stream as set forth in claim 1 wherein said sensing devices are located on or near a surface of said planar member and wherein said position signal indicates the location of said stream relative to said surface.

4. Apparatus for detecting the position of a liquid stream as set forth in claim 1 wherein each given one of said sensing devices produces an electrical output signal which indicates when said stream contacts said region near said given one of said sensing devices.

5. Apparatus for detecting the position of a liquid stream as set forth in claim 4 wherein the magnitude of said electrical output signal indicates the extent to which said stream impinges upon said region near said given one of said sensing devices.

6. Apparatus for detecting the position of a liquid stream as set forth in claim 1 wherein said position signal is derived from the weighted combination of output signals produced by different ones of said sensing devices.

7. A method of monitoring the presence, intensity, trajectory or position of a liquid stream comprising, in combination, the steps of:

directing said stream from a nozzle through the air in a trajectory directed at a target surface comprising an array of two or more sensors attached to a deformable membrane, employing said sensors to produce sensor output signals indicating a position or positions at which said stream impacts and deforms said membrane, and generating an output signal in response to said sensor output signals.

8. The method of monitoring set forth in claim 7 wherein said two or more sensors are aligned in a linear array and said output signal indicates the position of said stream relative to said linear array.

9. The method of monitoring set forth in claim 7 wherein said two or more sensors comprise four or more sensors aligned in a two dimensional array on said deformable membrane and said output signal indicates the position of said stream relative to said deformable membrane.

10. The method of monitoring set forth in claim 7 wherein the trajectory of said liquid stream is varied in response to an external effect to vary the position at which said stream impacts said target surface and wherein said output signal is indicative of the character of said external effect.

11. The method of monitoring as set forth in claim 7 wherein said step of generating an output signal includes the step of processing said sensor output signals in a digital processor to produce said output signal.

12. The method of monitoring as set forth in claim 7 wherein said output signal is a digital value indicating the current intensity, trajectory or position of said stream.

* * * * *